US007718931B2

(12) United States Patent
Wilkins

(10) Patent No.: US 7,718,931 B2
(45) Date of Patent: May 18, 2010

(54) ELECTRIC HEATER INCORPORATING A DEVICE FOR DETECTING A COOKING UTENSIL

(75) Inventor: Peter Ravenscroft Wilkins, Droitwich (GB)

(73) Assignee: Stylewell Limited, Cardiff (GB)

( * ) Notice: Subject to any disclaimer, the term of this patent is extended or adjusted under 35 U.S.C. 154(b) by 801 days.

(21) Appl. No.: 10/869,287

(22) Filed: Jun. 16, 2004

(65) Prior Publication Data

US 2004/0262296 A1 Dec. 30, 2004

(30) Foreign Application Priority Data

Jun. 26, 2003 (GB) ..... 0314929.1

(51) Int. Cl.
*H05B 3/68* (2006.01)

(52) U.S. Cl. ..... 219/448.11; 219/447.1; 219/448.14

(58) Field of Classification Search ..... 219/447.1, 219/448.11, 448.13, 518, 448.14, 448.16, 219/622, 624, 626, 623, 676, 675; 126/211, 126/396, 395, 37 A See application file for complete search history.

(56) References Cited

U.S. PATENT DOCUMENTS 5,223,697 A * 6/1993 Wilde et al. ..... 219/447.1
5,893,996 A * 4/1999 Gross et al. ..... 219/447.1
2002/0011480 A1* 1/2002 Schilling et al. ..... 219/448.11

FOREIGN PATENT DOCUMENTS

EP 0849976 6/1998

OTHER PUBLICATIONS

United Kingdom Search Report Feb. 3, 2004.

* cited by examiner

*Primary Examiner*—Quang T Van
(74) *Attorney, Agent, or Firm*—Ira S. Dorman

(57) ABSTRACT

An electric heater (10) incorporates at least one heating element (20), at least one wall member (16) upstanding in the heater, and a device (42) is provided for detecting a cooking utensil (6) supported on an upper surface (4) of a cooking plate (2) overlying the heater. The device (42) includes at least one inductively-operating loop (44) of electrically conductive material having a plurality of portions (50, 52, 54) adapted to extend over and spaced from the at least one electric heating element (20) between fixed supporting regions (56, 58, 60, 62) on the at least one wall member (16). The at least one loop (44) of electrically conductive material is such that the plurality of portions (50, 52, 54) are substantially incapable of self-support as such at normal operating temperatures of the electric heater. The plurality of portions (50, 52, 54) are supported by elongate members (64, 66, 68) of heat-withstanding material.

29 Claims, 4 Drawing Sheets

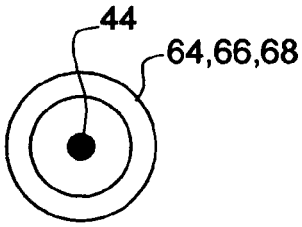
FIG 2A
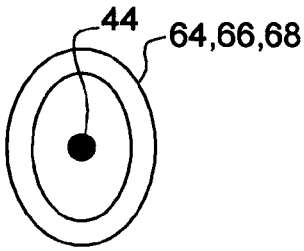
FIG 2B
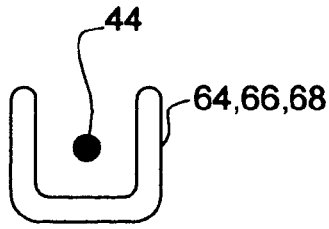
FIG 2C
FIG 3A
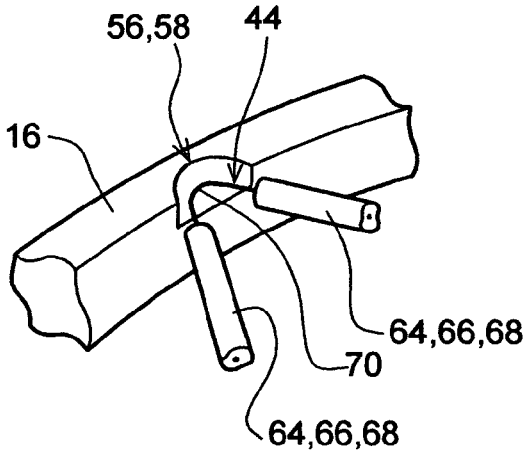
FIG 3B
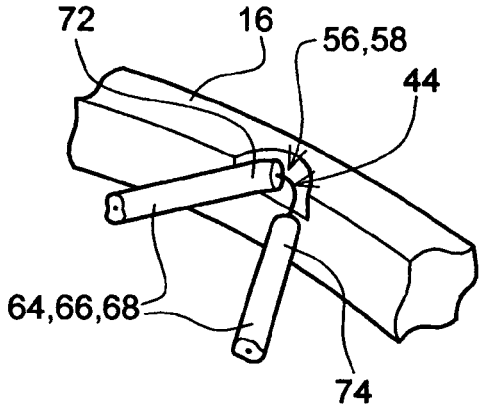
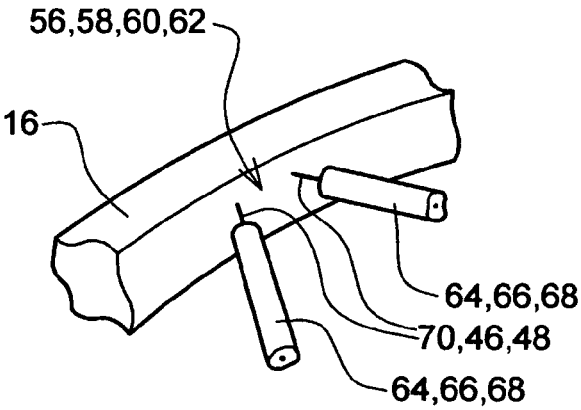
FIG 3C
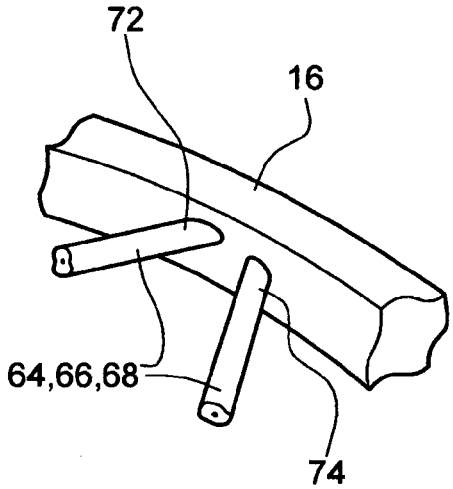
FIG 3D

ELECTRIC HEATER INCORPORATING A DEVICE FOR DETECTING A COOKING UTENSIL

This invention relates to an electric heater incorporating a device for detecting a cooking utensil, such as a pan, supported on an upper surface of a cooking plate, such as of glass-ceramic material, overlying the heater, the electric heater incorporating at least one electric heating element. Such a device comprises at least one inductively-operating loop of electrically conductive material which is provided in the heater and is electrically connected to an electrical circuit, such as an oscillatory circuit, which operates to detect changes in electrical inductance in the loop of electrically conductive material resulting from placement and/or removal of the cooking utensil on and/or from the upper surface of the cooking plate, and to effect appropriate energising and/or de-energising of the at least one electric heating element.

DESCRIPTION OF PRIOR ART

For efficient operation of the detecting device, it has been found necessary to provide the inductively-operating loop as close as possible to the lower surface of the cooking plate and also such that it extends spaced from and at least partly overlying the electric heating element. This has hitherto been accomplished by providing the loop of a relatively thick rigid wire material so as to be self-supporting where it overhangs the heating element, and particularly to avoid deformation and sagging when subjected to normal operating temperatures in the heater. Furthermore, because such a loop is exposed to direct thermal radiation from the underlying heating element or elements and subjected to temperatures of the order of 750 degrees Celsius, it has been found necessary to provide the loop of a relatively expensive material which is not susceptible to thermal damage by the direct thermal radiation from the heating element or elements.

It has also been proposed to provide a wire-form inductively-operating loop stretched across the top of a heater between supports at the periphery of the heater, the wire-form loop being suitably arranged in the form of an open triangle. However, in order to avoid deformation and sagging of the loop during operation of the heater, it has been found necessary to provide one or more elastically-resilient supports for the loop, to maintain a suitable mechanical tension in the loop. Such an arrangement is inconvenient to implement.

OBJECT OF THE INVENTION

It is an object of the present invention to overcome or minimise the aforementioned problems.

SUMMARY OF THE INVENTION

According to the present invention there is provided an electric heater incorporating at least one heating element, at least one wall member upstanding in the heater, and a device for detecting a cooking utensil supported on an upper surface of a cooking plate overlying the heater, the device comprising at least one inductively-operating loop of electrically conductive material having a plurality of portions thereof adapted to extend over and spaced from the at least one electric heating element between fixed supporting regions on the least one wall member, the at least one loop of electrically conductive material being such that the plurality of portions are substantially incapable of self-support as such at normal operating temperatures of the electric heater, the plurality of portions being supported by elongate members of heat-withstanding material.

For the avoidance of doubt, it is to be understood that by the plurality of portions of the at least one loop of electrically conductive material being substantially incapable of self-support at normal operating temperatures of the electric heater, it is meant that the plurality of portions would undergo deformation, such as sagging, at normal operating temperatures of the electric heater, if not supported.

The at least one wall member may be adapted to contact the lower surface of the cooking plate and may comprise thermal and electrical insulation material. The fixed supporting regions may be provided at upper regions of the at least one wall member, such as in the form of recesses or channels for receiving intermediate and/or end portions of the at least one loop of electrically conductive material or ends of the elongate members, or in the form of regions of the at least one wall member into which the intermediate and/or end portions of the at least one loop of electrically conductive material, or the ends of the elongate members, are embedded or moulded.

The elongate members of heat-withstanding material may comprise beams or tubes. Such beams may comprise channels for receiving the portions of the at least one loop of electrically conductive material, and the beams may be arranged such that the channels are open towards the lower surface of the cooking plate. Such tubes may be of circular, oval or rectangular cross-section.

The elongate members of heat-withstanding material may comprise ceramic material, such as steatite, cordierite, alumina or a glass material such as quartz.

The elongate members may each be substantially linear and may be arranged in a substantially rectangular, triangular, trapezoidal or V-shaped array.

The elongate members may be interconnected or united at ends thereof to form a frame.

The at least one loop of electrically conductive material may comprise a thin wire or ribbon of metal or metal alloy and may comprise a single turn thereof.

The at least one loop of electrically conductive material may comprise a material which is susceptible to damage by direct thermal radiation from the at least one electric heating element, the plurality of portions of the at least one loop being substantially protected from such damage by being shielded by the elongate members from the direct thermal radiation. The electrically conductive material may comprise a ferritic or austenitic stainless steel or a copper alloy.

The electric heater may comprise at least two heating zones, each incorporating at least one heating element and each being surrounded by one of the wall members, at least two of the loops of the electrically conductive material being provided, the loops being associated with the at least two heating zones to detect different sizes of the cooking utensil supported on the upper surface of the cooking plate.

The at least one loop of electrically conductive material may have open ends thereof adapted to be electrically connected to circuit means for detecting a change in electrical inductance in the at least one loop associated with placement and/or removal of the cooking utensil on and/or from the upper surface of the cooking plate and for effecting appropriate energising and/or de-energising of the at least one electric heating element.

The open ends of the at least one loop of electrically conductive material may be electrically connected to the circuit means by way of electrical terminal means provided at a peripheral region of the electric heater. Such electrical terminal means may be provided on a terminal block, which may comprise or form part of a housing associated with a temperature-responsive device provided on the electric heater.

The device may be provided as a modular assembly for attaching to the electric heater. Such modular assembly may include the at least one wall member.

The at least one wall member may comprise bound vermiculite.

The cooking plate may comprise glass-ceramic material.

The electric heater may comprise a base layer of thermal and electrical insulation material relative to which is supported the at least one electric heating element.

The electric heater may comprise a dish-like support, such as of metal.

By means of the present invention an inductively-operating loop of electrically conductive material may be provided of relatively thin wire or ribbon material, which has portions thereof supported by elongate members overlying one or more heating elements in a heater, the loop also being protected by the elongate members against thermal radiation damage from the heating element or elements, thereby avoiding a requirement for very high temperature-withstanding material to be used for the loop.

For a better understanding of the present invention and to show more clearly how it may be carried into effect, reference will now be made by way of example to the accompanying drawings in which:

BRIEF DESCRIPTION OF THE DRAWINGS

FIGS. 2A, 2B and 2C are cross-sectional views of alternative constructions of elongate members supporting portions of an inductively-operating loop of electrically conductive material in the detection device of FIG. 1;

FIGS. 3A to 3D are detailed perspective views of alternative arrangements of fixed supporting regions on a wall member, for the inductively-operating loop in the cooking utensil detection device of FIG. 1;

DESCRIPTION OF PREFERRED EMBODIMENTS

Figure 1:
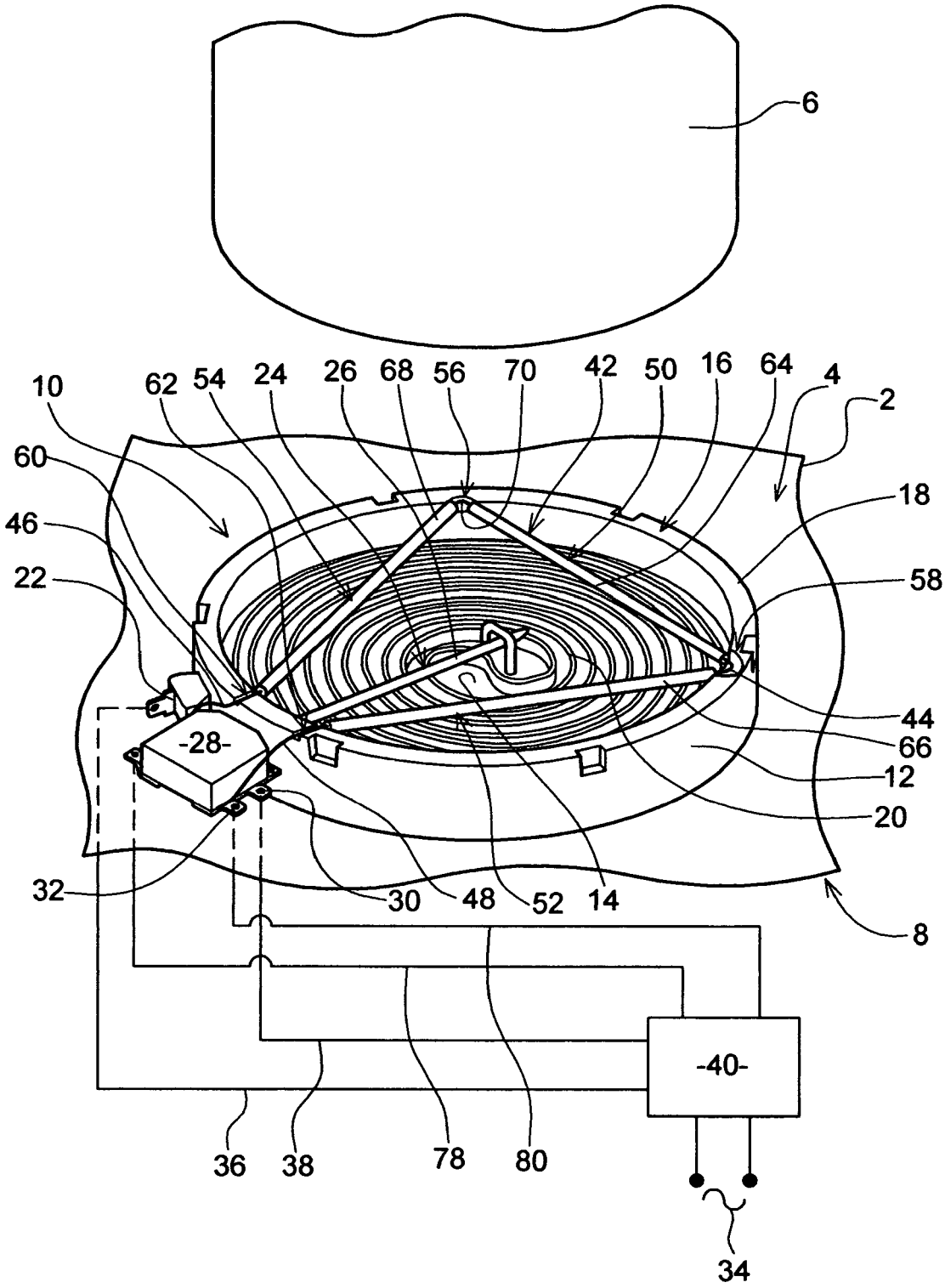
FIG. 1 is an exploded perspective view of an assembly of a cooking utensil supported on an upper surface of a cooking plate overlying an electric heater arranged in contact with a lower surface of the cooking plate, the electric heater being provided with an embodiment of a cooking utensil detection device according to the present invention.

Referring to FIG. 1, a glass-ceramic cooking plate 2 has an upper surface 4 for receiving a cooking utensil 6, such as a pan. A lower surface 8 of the cooking plate 2 has an electric heater 10 supported in contact therewith. The electric heater 10 comprises a dish-like support 12, such as of metal, in which is a base layer 14 of thermal and electrical insulation material, such as microporous thermal and electrical insulation material. A peripheral wall member 16 of thermal and electrical insulation material, such as bound vermiculite, is arranged upstanding in the dish-like support 12 and has an upper surface 18 contacting the lower surface 8 of the cooking plate 2.

At least one radiant electrical resistance heating element 20 is supported relative to the base layer 14. The heating element or elements 20 can comprise any of the well-known forms of heating element, such as wire, ribbon, foil or lamp forms, or combinations thereof. In particular, the heating element or elements 20 can be of corrugated ribbon form, supported edgewise on the base layer 14 of insulation material.

A terminal block 22 is provided at the edge of the dish-like support 12 and electrically connected to one end of the heating element or elements 20.

A temperature-responsive device 24, of known basic construction, has an elongate probe portion 26 extending at least partly across the heater and overlying the heating element or elements 20. The temperature-responsive device 24 also has a housing portion 28 of electrically insulating material arranged externally of the heater and suitably containing one or more switch components of known form. The housing portion 28 supports electrical terminals, two of which are visible in FIG. 1 and denoted by reference numerals 30 and 32. The heating element or elements 20 is or are electrically connected to a power supply 34 by way of leads 36 and 38 and a control system 40, which may include microprocessor-based circuitry. The lead 36 is connected to one end of the heating element or elements 20 by way of the terminal block 22. The lead 38 is connected to the other end of the heating element or elements 20 by way of the terminal 30 on one side of the housing portion 28 of the temperature-responsive device 24, a switch means (not shown) inside the housing portion 28, and a further terminal (not shown) on the opposite side of the housing portion 28.

A device 42 is provided for detecting the cooking utensil 6 when placed on and removed from the cooking plate 2 and operating to automatically energise and de-energise the heater 10 by way of the control system 40. The device 42 comprises an inductively-operating loop 44 of electrically conductive material, in the form of thin wire or ribbon, having open end or terminal portions 46, 48. The loop 44 of wire or ribbon suitably comprises a ferritic or austenitic stainless steel or a copper alloy.

The loop 44 has three portions 50, 52, 54 arranged in triangular form and extending over and spaced from the heating element or elements 20, between fixed supporting regions 56, 58, 60 and 62 provided at upper regions of the wall member 16.

The wire or ribbon material of the loop 44 is such that the wire or ribbon portions 50, 52, 54 of the loop are substantially incapable of self-support per se and if used alone would deform and sag, particularly under the high temperature operating conditions of the heater, which involves temperatures of up to about 750 degrees Celsius. Furthermore, the material of the loop 44 would be susceptible to harmful damage and degradation if subjected to direct thermal radiation from the heating element or elements 20. These problems are overcome in the present invention by providing elongate members 64, 66, 68 of heat-withstanding material to support and shield the portions 50, 52, 54 of the loop 44. The elongate members 64, 66, 68 suitably comprise ceramic material, such as steatite, cordierite, alumina or a glass material such as quartz. The elongate members 64, 66, 68, are substantially linear and may be in the form of tubes, such as of circular or oval cross-section, as shown in FIGS. 2A and 2B, or may be in the form of channels, as shown in FIG. 2C. Such channels are suitably arranged to be open towards the lower surface 8 of the cooking plate 2.

The fixed supporting regions 56, 58, 60 and 62 are suitably provided at upper regions of the wall member 16 and may be in the form of recesses or channels for receiving intermediate 70 and/or end 46, 48 portions of the loop 44, for example as illustrated in FIG. 3A, or for receiving ends 72, 74 of the elongate members 64, 66, 68, such as illustrated in FIG. 3B.

Alternatively, the fixed supporting regions 56, 58, 60 and 62 may comprise upper regions of the wall member 16 into which the intermediate 70 and/or end portions 46, 48 of the loop 44 are embedded or moulded, as illustrated in FIG. 3C, or into which the ends 72, 74 of the elongate members 64, 66, 68 are embedded or moulded, as illustrated in FIG. 3D.

Figure 4:
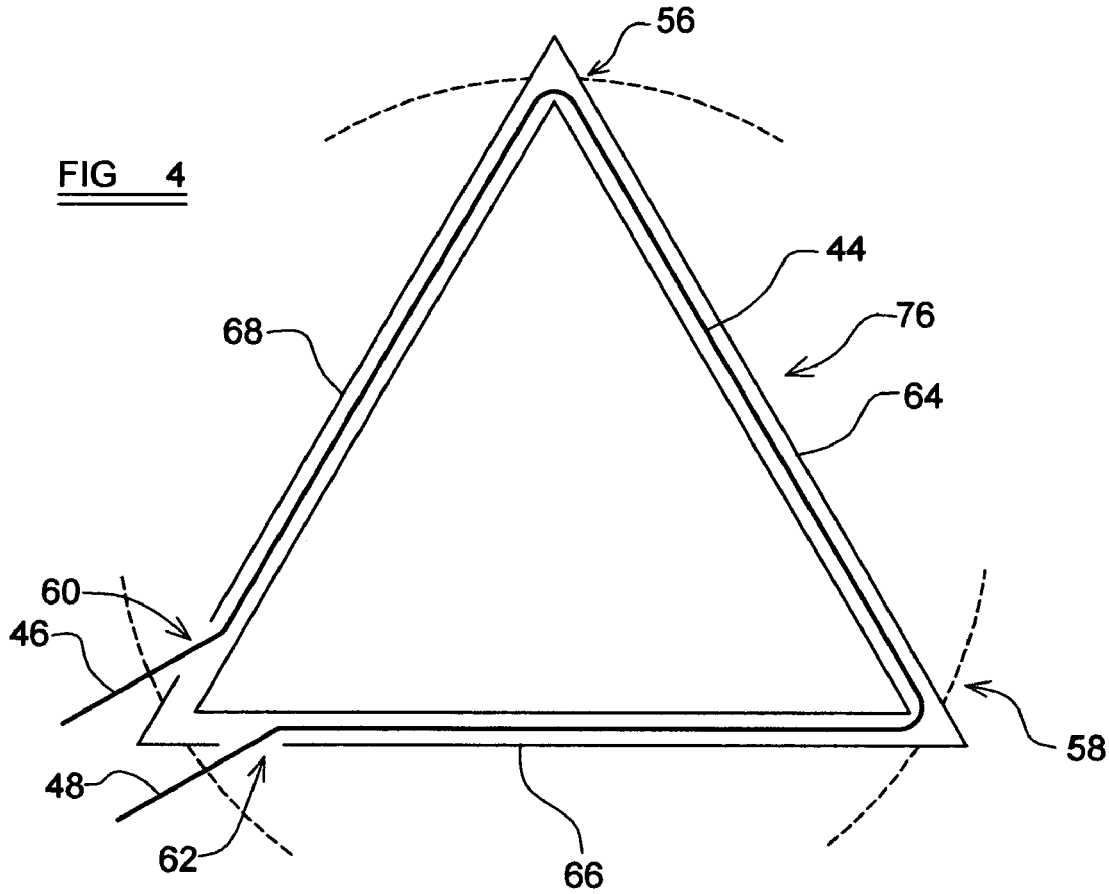
FIG. 4 is a plan view of an integral arrangement of the elongate members supporting the portions of the inductively-operating loop, for use as an alternative arrangement in the detection device of FIG. 1.

As illustrated in FIG. 4, the elongate members 64, 66, 68 may be interconnected or united at ends thereof to form an integral frame 76, particularly of channel form, in which the loop 44 is supported, the frame 76 being supported at fixed supporting regions on the wall member 16, in similar manner as previously described with reference to the supporting regions 56, 58, 60 and 62.

The terminal or end portions 46 and 48 of the loop 44 are arranged to exit the heater 10, through appropriate apertures in the dish-like support 12, and are conveniently connected to terminals provided on either side of the housing portion 28 of the temperature-responsive device 24, although a separate terminal block could be provided if desired. Only one such terminal, denoted by reference numeral 32, is visible in FIG. 1. These terminals have no electrical connection to the temperature-responsive device 24 and leads 78, 80 are provided therefrom to the control system 40.

The control system 40 is adapted to operate in known manner to detect a change in electrical inductance in the loop 44 associated with placement and/or removal of the cooking utensil 6 on and/or from the upper surface 4 of the cooking plate 2 and for effecting appropriate energising and/or de-energising of the heating element or elements 20. Such control system 40 may, for example, include an electrical oscillatory or resonant circuit.

Figure 5:
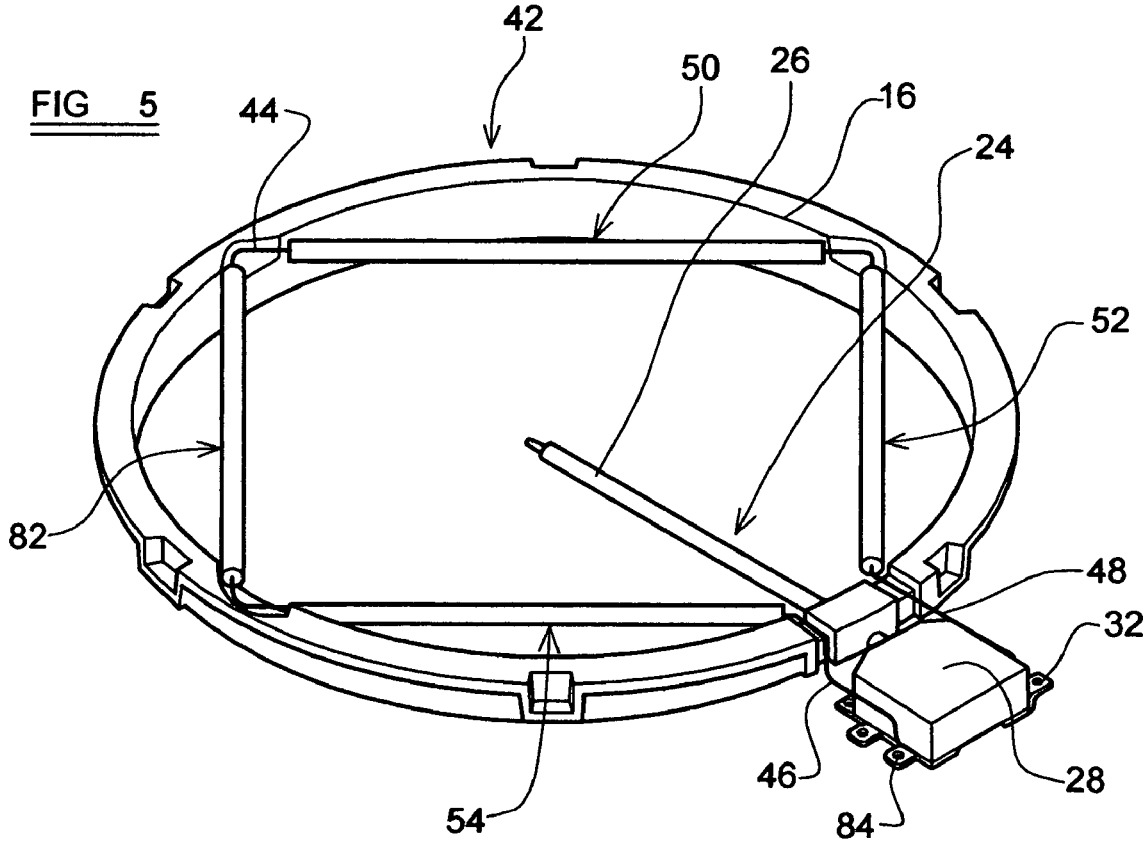
FIG. 5 is a perspective view of an alternative embodiment of cooking utensil detection device according to the present invention.

Although a triangular arrangement of the loop 44 is shown in FIG. 1, other arrangements are possible. For example, one of the three portions 50, 52, 54 of the loop could be dispensed with and a simple V-shaped arrangement of the loop 44 provided. Alternatively, an arrangement of four or more portions of the loop could be provided, such as to provide a rectangular or trapezoidal arrangement of the loop portions. This is illustrated in FIG. 5, in which, in addition to the three portions 50, 52 and 54 of the loop, a further portion 82 is included, to provide the rectangular or trapezoidal arrangement. The construction, including the support of the loop on the wall member 16, the mounting on the associated heater 10, and the electrical connections and control system, are substantially as previously described with reference to FIG. 1.

FIG. 5 also illustrates a further feature of the present invention. The detection device 42 can be provided in modular form for easy fitting to an electric heater. The loop 44, with whatever selected number of portions, is pre-assembled on the wall member 16 and may also be pre-assembled with its end terminal regions 46, 48 connected to electrical terminals 32 and 84 provided on the housing portion 28 of the temperature-responsive device 24, or on a separate terminal block if desired.

Figure 6:
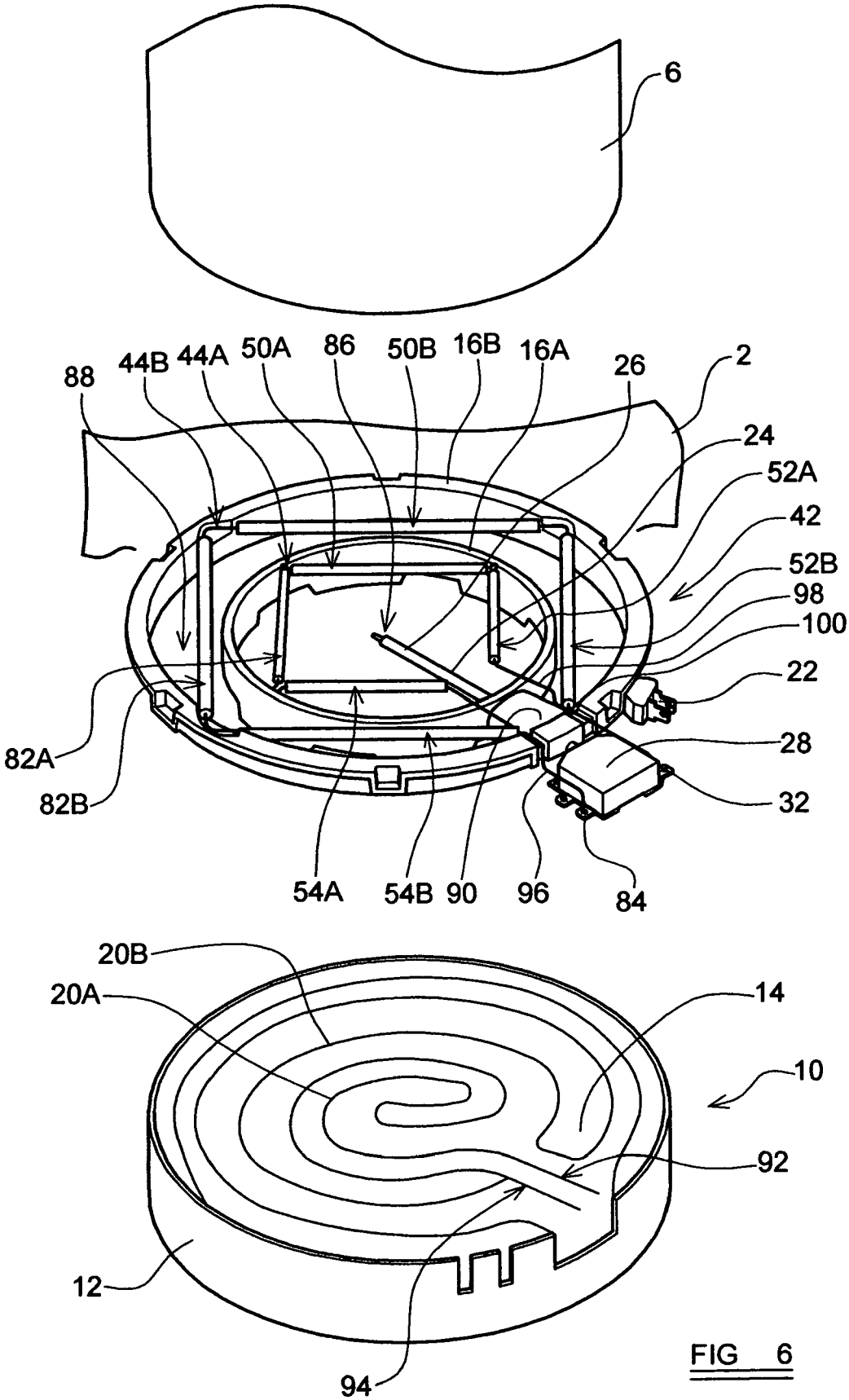
FIG. 6 is an exploded perspective view of a further assembly of a cooking utensil supported on an upper surface of a cooking plate overlying an electric heater arranged in contact with a lower surface of the cooking plate, the electric heater having two heating zones and being provided with a further embodiment of cooking utensil detection device according to the present invention.

The device of the present invention can also be applied to heaters having more than one heating zone, such as two or more concentrically-arranged heating zones, and used to energise one or more heating zones according to the size of cooking utensil 6 detected on the cooking plate 2. This is illustrated in FIG. 6. Here an electric heater 10, with a metal dish-like support 12 and a base layer 14 of insulation material is provided with two concentric heating elements 20A and 20B, which are arranged such that inner element 20A can be either energised alone or together with outer element 20B. The detection device 42 comprises an inner wall member 16A concentrically arranged with an outer wall member 16B. The inner wall member 16A provides the heater with two separated heating zones 86 and 88, the outer wall member 16B serving as a peripheral wall on the heater 10. A tunnel 90 of thermal insulation material extends across the outer heating zone 88. Terminal portions 92, 94 of the inner heating element 20A pass through the tunnel 90 for connection to a terminal block 22 and/or terminals on a housing portion 28 of a temperature-responsive device 24. An elongate probe portion 26 of the temperature-responsive device 24 also passes through the tunnel 90. Two inductively-operating loops 44A and 44B are provided, each constructed in substantially the same manner as previously described with reference to FIGS. 1 to 5. Loop 44A has its portions 50A, 52A, 54A and 82A supported and shielded by their associated elongate tubular or channel-form members and extending in the inner heating zone 86 between the fixed supporting regions on the wall member 16A. Loop 44B has its portions 50B, 52B, 54B and 82B supported and shielded by their associated elongate tubular or channel-form members and extending in the outer heating zone 88 between the fixed supporting regions on the wall member 16B.

The two loops 44A and 44B have a common end terminal region 96 extending outside of the heater 10 and connected to a terminal 84 provided on the housing 28 of the temperature-responsive device 24. The other end terminal regions 98, 100 of the loops 44A and 44B respectively, also extend outside of the heater 10 and are connected to further separate terminals, only one of which 32 is shown, provided on the housing portion 28 of the temperature-responsive device 24. In substantially the same way as previously described with reference to FIG. 1, leads are provided, extending from the terminals on the housing portion 28 and the terminal block 22, to a control system (such as the control system 40 of FIG. 1), to enable the electrical inductance in the loops 44A and 44B to be monitored.

The control system monitors the electrical inductance of the loops 44A and 44B, the inductance values varying according to whether a large cooking utensil 6 is located on the cooking plate 2 and covering both heating zones 86, 88 of the heater 10, or whether a small cooking utensil 6 is located on the cooking plate 2 and covering substantially only the inner heating zone 86. When a small cooking utensil 6 is located, the control system operates to automatically energise only the heating element 20A in the inner heating zone 86. When a larger cooking utensil 6 is located, the control system operates to automatically energise the heating elements 20A and 20B in the inner and outer heating zones 86 and 88.

I claim:

1. An electric heater incorporating at least one heating element, at least one wall member upstanding in the heater, and a device for detecting a cooking utensil supported on an upper surface of a cooking plate overlying the heater, the device comprising at least one inductively operating loop of electrically conductive material having a plurality of portions thereof adapted to extend over and spaced from the at least one electric heating element between fixed supporting regions on the at least one wall member, the at least one loop of electrically conductive material being such that the plurality of portions are substantially incapable of self-support as such at normal operating temperatures of the electric heater, the plurality of portions being supported by elongate members of heat-withstanding material.

2. A heater as claimed in claim 1, wherein the at least one wall member is adapted to contact the lower surface of the cooking plate.

3. A heater as claimed in claim 1, wherein the at least one wall member comprises thermal and electrical insulation material.

4. A heater as claimed in claim 1, wherein the fixed supporting regions are provided at upper regions of the at least one wall member.

5. A heater as claimed in claim 4, wherein the fixed supporting regions are provided in the form of recesses or channels for receiving at least one of: at least one of intermediate portions and end portions of the at least one loop of electrically conductive material; and at least one of the ends of the elongate members.

6. A heater as claimed in claim 4, wherein the fixed supporting regions are provided in the form of regions of the at least one wall member into which at least one of: at least one of the intermediate portions and end portions of the at least one loop of electrically conductive material are embedded or moulded; and at least one of the ends of the elongate members are embedded or moulded.

7. A heater as claimed in claim 1, wherein the elongate members of heat-withstanding material are selected from beams and tubes.

8. A heater as claimed in claim 7, wherein the beams comprise channels for receiving the portions of the at least one loop of electrically conductive material.

9. A heater as claimed in claim 8, wherein the beams are arranged such that the channels are open towards the lower surface of the cooking plate.

10. A heater as claimed in claim 7, wherein the tubes are selected from circular, oval and rectangular cross-section tubes.

11. A heater as claimed in claim 1, wherein the elongate members of heat-withstanding material comprise ceramic material.

12. A heater as claimed in claim 11, wherein the ceramic material is selected from steatite, cordierite, alumina and a glass material such as quartz.

13. A heater as claimed in claim 1, wherein the elongate members are each substantially linear.

14. A heater as claimed in claim 13, wherein the elongate members are arranged in a configuration selected from a substantially rectangular, a substantially triangular, a substantially trapezoidal and a substantially V-shaped array.

15. A heater as claimed in claim 1, wherein the elongate members are interconnected or united at ends thereof to form a frame.

16. A heater as claimed in claim 1, wherein the at least one loop of electrically conductive material comprises a material in a form selected from thin wire and ribbon having a composition selected from metal and metal alloy.

17. A heater as claimed in claim 16, wherein the at least one loop of electrically conductive material comprises a single turn of the thin wire or ribbon.

18. A heater as claimed in claim 1, wherein the at least one loop of electrically conductive material comprises a material which is susceptible to damage by direct thermal radiation from the at least one electric heating element, the plurality of portions of the at least one loop being substantially protected from such damage by being shielded by the elongate members from the direct thermal radiation.

19. A heater as claimed in claim 18, wherein the electrically conductive material comprises a material selected from ferritic stainless steel, austenitic stainless steel and a copper alloy.

20. A heater as claimed in claim 1 and including at least two heating zones, each incorporating at least one heating element and each being surrounded by one of the wall members, at least two of the loops of the electrically conductive material being provided, the loops being associated with the at least two heating zones to detect different sizes of the cooking utensil supported on the upper surface of the cooking plate.

21. A heater as claimed in claim 1, wherein the at least one loop of electrically conductive material has open ends thereof adapted to be electrically connected to circuit means for detecting a change in electrical inductance in the at least one loop associated with placement and/or removal of the cooking utensil relative to the upper surface of the cooking plate and for effecting an appropriate one of energising and de-energising the at least one electric heating element.

22. A heater as claimed in claim 21, wherein the open ends of the at least one loop of electrically conductive material are electrically connected to electrical terminal means provided at a peripheral region of the electric heater.

23. A heater as claimed in claim 22, wherein the electrical terminal means are provided on a terminal block.

24. A heater as claimed in claim 23, wherein the terminal block comprises or forms part of a housing associated with a temperature-responsive device provided on the electric heater.

25. A heater as claimed in claim 1, wherein the at least one wall member comprises bound vermiculite.

26. A heater as claimed in claim 1, wherein the cooking plate comprises glass-ceramic material.

27. A heater as claimed in claim 1 and including a base layer of thermal and electrical insulation material relative to which is supported the at least one electric heating element.

28. A heater as claimed in claim 1 and including a dish-like support.

29. A heater as claimed in claim 28, wherein the dish-like support comprises metal.

* * * * *